US007908084B2

(12) United States Patent
Anderegg et al.

(10) Patent No.: US 7,908,084 B2
(45) Date of Patent: Mar. 15, 2011

(54) SYSTEM FOR CO-ORDINATED GROUND PROCESSING

(75) Inventors: Roland Anderegg, Olten (CH); Kuno Kaufmann, Subingen (CH); Nicole Marti, Langenthal (CH)

(73) Assignee: Ammann Schweiz AG, Langenthal (CH)

( * ) Notice: Subject to any disclaimer, the term of this patent is extended or adjusted under 35 U.S.C. 154(b) by 323 days.

(21) Appl. No.: 11/886,728

(22) PCT Filed: Mar. 23, 2006

(86) PCT No.: PCT/CH2006/000172

§ 371 (c)(1),
(2), (4) Date: Dec. 13, 2007

(87) PCT Pub. No.: WO2006/099772

PCT Pub. Date: Sep. 28, 2006

(65) Prior Publication Data

US 2009/0126953 A1 May 21, 2009

(30) Foreign Application Priority Data

Mar. 23, 2005 (EP) ..... 05405266

(51) Int. Cl.
*G06F 19/00* (2006.01)

(52) U.S. Cl. ..... 702/1

(58) Field of Classification Search ..... 702/2, 35–41, 702/44, 1, 33, 43, 56, 76, 84, 137, 183, 185; 73/78, 84, 573, 593, 646–648, 784; 404/84.1, 404/117, 122; 405/271

See application file for complete search history.

(56) References Cited

U.S. PATENT DOCUMENTS

| | | | | |
|---|---|---|---|---|
| 5,727,900 | A | 3/1998 | Sandstrom | |
| 6,122,601 | A * | 9/2000 | Swanson et al. | 702/137 |
| 6,973,821 | B2 * | 12/2005 | Corcoran | 73/78 |
| 2007/0150147 | A1 * | 6/2007 | Rasmussen et al. | 701/50 |

FOREIGN PATENT DOCUMENTS

| | | | |
|---|---|---|---|
| DE | 199 56 943 | A1 | 5/2001 |
| WO | WO-95/28524 | A1 | 10/1995 |
| WO | WO-98/17865 | A1 | 4/1998 |
| WO | WO-02/44475 | A1 | 6/2002 |
| WO | WO-2004/090232 | A1 | 10/2004 |
| WO | WO-2005/028755 | A1 | 3/2005 |

* cited by examiner

*Primary Examiner* — Mohamed Charioui
(74) *Attorney, Agent, or Firm* — Birch, Stewart, Kolasch & Birch, LLP

(57) ABSTRACT

The invention relates to a system for co-ordinated soil cultivation, said system comprising a plurality of soil compacting devices (W1, W2) used to determine location-related relative compacting values (V(W1; TB1, xi, yi;I−1 . . . n)), and a calibrating device (EV) used to determine location-related absolute compacting values. A calculating unit (R), which is connected to the compacting devices (W1, W2) and the calibrating device (EV) in such a way as to transmit messages, is used to correlate the obtained relative and absolute location-related compacting values. A system control (CPU1, . . . , CPU4) is embodied in such a way that the location-related relative compacting values of the compacting devices (W1, W2) and the location-related absolute compacting values are transmitted to the calculating unit (R) in a continuous manner, stored therein, and in the event of the presence of compacting values in the same location, compacting correlation values are calculated and transmitted to the compacting devices where they are stored as correction values.

21 Claims, 8 Drawing Sheets

Fig tree scenario

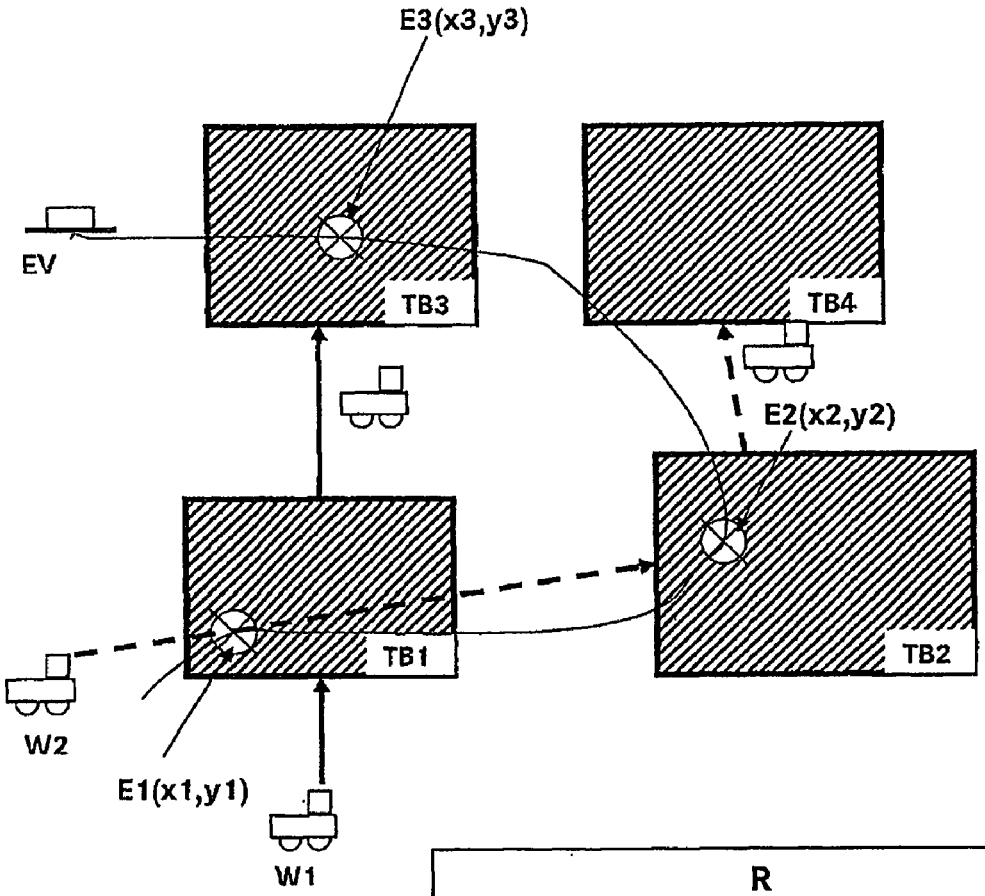
R
K(W1,TB1) = corr.[ E1(x1,y1) ↔ V(W1;TB1; x1,y1) ]
V(W1;TB1, xi, yi; i=1...n)
K(W2,TB1) = corr.[ E1(x1,y1) ↔ V(W2;TB1; x1,y1) ]
V(W2;TB2,xi,yi; i = 1 ... n)
Fig. 9
Fig. 10
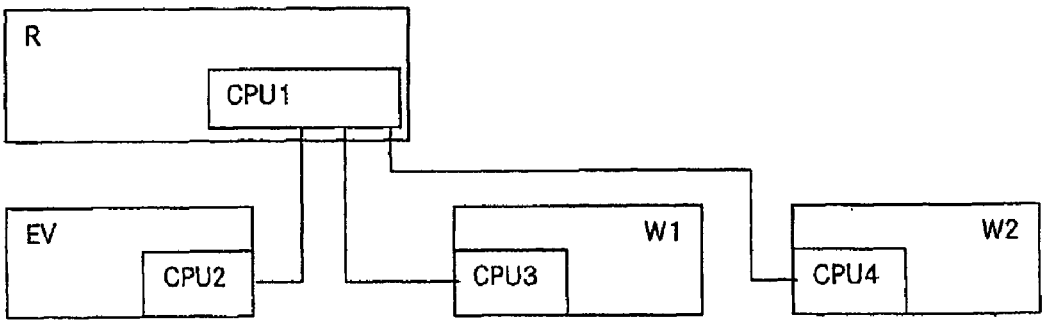

SYSTEM FOR CO-ORDINATED GROUND PROCESSING

TECHNICAL FIELD

The invention relates to a system for coordinated ground processing, to a method for compaction of at least one ground area (3) or at least one covering area which is applied to a ground area to a predetermined area-specific compaction nominal value, to a compaction apparatus for a system such as this, and to an operating method for the system.

PRIOR ART

WO 2005/028755 (Ammann) discloses a method and an apparatus for determination of relative and absolute ground stiffness value for a ground area. The apparatus is operated in close contact with the ground in order to determine the absolute ground stiffness values. The ground and apparatus in this case form a single oscillating system. In order to determine the relative values, the apparatus is moved in a jumping form over the ground surface, with the amplitude values and frequencies of the subharmonic frequency values that are formed with respect to the excitation frequency being evaluated during this process. The absolute measurement relates to a measurement at one point, while the relative measurement is carried out while driving over the area. Since the relative measurements are converted via the absolute measurement to absolute values, a relative ground stiffness determined while driving over the area for compaction purposes can be converted to an absolute value of the ground stiffness. The values which are determined in this case are displayed to the vehicle driver of the compaction apparatus, who then has to decide on the further compaction procedure.

DE 199 56 943 A1 (Bomag) describes an apparatus for monitoring compaction for vibration compaction appliances. Compaction monitoring is used to measure and display a first compaction measured value, which is produced by a first compaction apparatus, for blacktops in road and track construction, and to compare them with a second compaction value produced by a second compaction apparatus, with the second compaction values having been determined while the asphalt temperature is still approximately the same. The second compaction apparatus is coupled to the first such that it essentially follows the same track. In this case, the compacting vibration rollers can also be provided in two separate roller trains, and the two roller trains can be coupled to one another via a computer-aided slaving system or steering system. Coupled steering on the correct track can be carried out by means of a global positioning system (GPS) or by means of radar, ultrasound or infrared. The extent of compaction achieved is deduced by measurement of oscillation reflections during the compaction process. When the compaction level no longer changes in the compaction monitoring apparatus despite the number of compaction runs over the area having been increased, it is assumed that the highest density which can be achieved with a specific compaction appliance has been reached. The compaction values that are reached are indicated to the roller driver on a display unit.

DESCRIPTION OF THE INVENTION

The object of the invention is to provide a system which is associated with the technical field mentioned initially, by means of which optimum ground compaction can be achieved in an optimum time frame.

The object is achieved by the features of claim 1. According to the invention, a system for co-ordinated ground processing has a plurality of compaction apparatuses for ground compaction, with the compaction apparatuses being designed to determine position-related relative compaction values. The system also has a calibration apparatus for determination of position-related absolute compaction values, and a computation unit for correlation of relative and absolute position-related compaction values, with the compaction apparatuses, calibration apparatus and computation unit being connected to one another for information transmission purposes. Finally, a system controller is provided and is designed such that the position-related relative compaction values of the compaction apparatuses and the position-related absolute compaction values are transmitted continuously to the computation unit, are stored there and, if compaction values at the same position are present, compaction correlation values are calculated, are transmitted to the compaction apparatuses and are stored there as a correction value.

This is a system that is networked throughout and can monitor, co-ordinate and control the compaction tasks at a large building site where a plurality (that is to say at least two and preferably more than three) compaction apparatuses (compaction rollers, vibration plates, etc.) can be used at different locations at the same time or sequentially in time. The calibration apparatus (for example pressure plate) which is connected to the system allows instantaneous calibration or matching of the compaction apparatuses which are being used, for example, at a different point on the building site and which have processed the calibrated point or have determined at least relative compaction values at this point. The compaction values are always provided with position co-ordinates in the system, that is to say a correct data record includes at least a compaction value and location. Further data can be attached, such as the time, identification of the machine, layer thickness, material characteristics.

The system controller can be embodied in many different ways. It is typically a computer program which has various modules which are installed on the compaction apparatuses, the calibration apparatus and the central computation unit and monitor the timing and the communication for information transmission purposes. By way of example, the computation unit can check the various appliances.

The computation unit is typically contained in a fixed-position server and may be formed by software installed on the server. However, it is also possible to provide one of the apparatuses being used on the building site (for example the calibration apparatus or one of the compaction apparatuses) with the computation unit. A separate dedicated network or a generally available public network (for example GSM, radio telephone) can be used for communicating information between the appliances.

A typical system according to the invention will have a plurality of rollers (weight, power, technology). It is therefore worthwhile for each compaction apparatus to be identified in the system by a code and for each measurement to be provided with the identification of the compaction apparatus. The system can be scaled in this way, that is to say new appliances can be added as required (or can be integrated in the system). Furthermore, this makes it possible to monitor the quality of the compaction apparatuses, because there are always various comparison options.

It is, of course, feasible for the system to be controlled peripherally rather than centrally. This means that one compaction apparatus autonomously checks with the control center (computation unit) whether compaction values have already been recorded at the point where it is being used, and that the control center transmits existing values, when available. There is then no need for the control center to store the compaction values together with an identification.

Data is primarily stored in the computation unit where, in practice, a map is formed of the data for the terrain to be processed. The system controller preferably ensures that the compaction apparatuses are moved to the locations of the absolute calibration measurements at specific intervals and/or as a function of the number and placing of the available absolute compaction values, where they determine the relative compaction value, which can then be compared or correlated with the calibration value. When a compaction apparatus is correlated or calibrated with a calibration measurement in this way, a ground subarea which has been processed by this calibrated compaction apparatus can once again be used as a (possibly only provisional) reference for a further compaction apparatus, which has not yet been calibrated at all. The measurement systems of the compaction apparatuses can in this way be matched to one another systematically and continuously, throughout the system.

For simplification purposes, it is also possible to store only quite specific calibration points in the system. A correlation is then carried out only with respect to these individual positions, and there is no need to store a ground compaction data map.

The arrangement according to the invention of the appliances which communicate with one another is preferably configured in the form of a complete building-site management system. Technical and physical characteristics of the ground areas are also stored in a corresponding manner (for example geometry, consistency and other characteristics of the ground layers). Data can also be recorded which is required for cost calculation. This means that it is possible to prepare the terrain (for example the route for a road) more quickly and cost-effectively.

The position-finding process can be carried out in various ways. Each unit is preferably equipped with a GPS receiver (that is to say in an entirely general form with a receiver for satellite-based position-finding). Locally, the position can also be determined using a reference system that is specific to the building site (by positioning fixed transmitters/receivers with respect to which the units can be oriented).

The calibration apparatus is preferably a standard apparatus for carrying out the pressure-plate trial (DIN 18 196). If the standard or the building-site management allows a different apparatus to be used to determine the absolute compaction value, for example a compaction roller which is designed to determine absolute compaction values or a vibration plate for determination of absolute ground stiffness values (WO 2005/028755, Ammann), an apparatus such as this can also be used as the calibration apparatus in the system, for the purposes of the invention. A further compaction apparatus is therefore used as the calibration apparatus and is designed to determine not only relative but also absolute compaction values. At this point, it should be noted that the system according to the invention may also in fact have a plurality of calibration apparatuses.

The system according to the invention can be operated using widely differing methods. A compacted ground area is produced, for example, by the following steps:

a) at least one subarea of the ground area is driven over with a compaction apparatus which determines at least one relative, position-related compaction value while the area is being driven over,
b) determination of an absolute position-related compaction value in the subarea by means of a calibration apparatus,
c) automatic transmission of information relating to relative and position-related absolute compaction values determined in step a) and b) to a computation unit,
d) determination of at least one correlation value between the relative and absolute compaction value,
e) automatic transmission of the correlation value to the compaction apparatus, and
f) readjustment of a reference value—if necessary—in the compaction apparatus corresponding to the transmitted correlation value.

The calibration apparatus can be used first of all to determine the position-related absolute compaction value, with the compaction apparatus being driven over the corresponding subarea in a non-compacting manner at a later time, in order to determine at least one position-related relative compaction value when driving over it.

However, the compaction apparatus can also be used first of all to drive over the subarea in a compacting manner, and to determine at least one position-related relative compaction value while driving over it, and to determine the position-related absolute compaction value at a later time.

A plurality (at least two, and preferably three or more) subareas are typically driven over, both by a first compaction apparatus and by a further compaction apparatus. The position-related relative compaction values are transmitted to the control center, which calculates a correlation between the various measured values and thus between the compaction apparatuses.

One advantage of the invention is that the workload is reduced on the person (for example roller driver) who is having to drive the compaction apparatus. Since, inter alia, the invention results in the machine settings (driving routes, speed of driving over the area and compactor values) being obtained automatically for optimum compaction in a reduced time, the driver of the compaction apparatus can now concentrate entirely on driving the compaction apparatus and the safety conditions to be observed. This avoids the need for subsequently "shaking up" ground areas by unnecessarily driving over them again. Further driving over the area, which is necessary for example in order to reach areas which still need to be compacted, can now be carried out in such a way that no more "shaking up" is carried out. It is also possible to use a group comprising a plurality of compaction apparatuses which, in addition, may also have different power devices for any compaction to be carried out.

In order to achieve this aim, compaction apparatuses are used which have compactor values which can be set automatically. The expression compactor values means, in particular, an adjustable ground reaction force $F_B$ and a phase angle $\phi$. The phase angle $\phi$ is an angle between the maximum ground reaction force $F_B$ directed at right angles to the surface of the ground area and a maximum oscillation value of an oscillation response of an oscillating system. This oscillating system is formed, as stated below, from the ground area and the vibration unit which carries out the compaction in the compaction apparatus. Unbalances with an unbalance moment and an unbalance frequency are generally used for compaction. Since, in the case of the invention, the compactor values are automatically set by a controlled adjustment device, the unbalance moment and unbalance frequency are controlled analogously, that is to say they are set as determined by a computation unit.

By way of example, when driving over an area for the first time, the unbalance moment and unbalance frequency are now set by an adjustment unit such that a predetermined compaction nominal value for a ground area or a covering which is arranged on a ground area is achieved on the basis of theoretical calculations. The compaction nominal value will in general be the same at long distances, but need not be, since, in fact, the unbalance moment and unbalance frequency can be adjusted automatically. As is stated specifically below, the achieved ground compaction is determined immediately when driving over the area, and the determined compaction actual value is stored together with the position coordinates for that area, for subsequent treatment.

The expression compactor values means the movements of the compaction apparatus which cause the compaction. The expression "compaction" is in each case related to the ground or covering to be compacted or being compacted.

This subsequent treatment may now comprise driving over the area once again for compaction or else a treatment of the ground area if the repeated position-related compaction measurements show that this ground area cannot be compacted any further, for example because of its material composition, the ground underneath, etc.

The impossibility of further compaction can be confirmed by determining the compaction actual values achieved on a position-related basis for each compaction process, and by storing them. These stored values are compared. If no (significant) increase in the compaction is found, then this area can in fact not be compacted any more. In order to prevent damage from being caused in this area by further compaction processes, and in order to save time, the unbalance moment and unbalance frequency can be set over this area such that it is driven over only with a surface-smoothing effect.

An unbalance moment and unbalance frequency for driving over an area with a surface-smoothing effect can also be set when an area has already been compacted to the required compaction value and adjacent areas or areas on a predetermined route have not yet reached this value. This surface-smoothing "resetting" of the machine compaction data on the one hand allows the area to be driven over more quickly while on the other hand avoiding an area that has already been compacted being "shaken up".

In contrast to the known ground compaction systems, the nominal values for the ground force $F_B$ and the phase angle $\phi$ can be determined and set directly at the relevant location (area). In contrast to the "manually set" compaction apparatuses according to the prior art, the compaction apparatus according to the invention is an "automatic compaction apparatus".

If a plurality of areas have already been adequately compacted, then these areas can be bypassed. The computation unit which is processing the position-related compaction actual values from the storage unit will now propose a route to the driver of the compaction apparatus. The proposed route can be displayed on a display unit arranged in the driver's cab. However, the route can also be reflected onto the so-called windshield, or can be displayed directly by means of a light beam, in particular by means of a laser beam (for example a red helium neon laser beam) on the ground areas. A display on the ground surface has the advantage that this indicates to the workers the clearing for the route that is intended to be compacted, or which must not be entered, or the area from which machines must be removed.

In the case of relatively large building sites, a plurality of compaction apparatuses are generally used, and may also have different apparatus data for the compaction to be carried out. The logic for each compaction apparatus knows its specific compaction characteristics and can appropriately set the unbalance moment and unbalance frequency from the predetermined compaction nominal values, by means of an adjustment unit.

Since relatively large masses are generally used to produce vibration required for compaction, a timer is preferably provided. The timer knows the machine-typical adjustment time and therefore knows, for a predetermined movement speed (generally the speed of travel) the time interval during which adjustment must be commenced in order to apply the determined unbalance moment and the determined unbalance frequency on reaching the relevant area.

When using a plurality of compaction apparatuses, it is no longer sufficient to store the predetermined area-specific compaction nominal value, to determine the position association by means of a triangulation system or GPS and to store the determined compaction actual values on a position-related (area-specific) basis in order that they can be considered for another compaction process. When a plurality of compaction apparatuses are being used, they are generally driven in columns so that one and the same compaction apparatus does not always drive over areas that have already been compacted by it. In this case, the compaction actual values are preferably transmitted from one apparatus to another by means of transmission and reception installations. Each compaction apparatus then preferably also has a system for exact position-finding.

The compaction and position data can now be transmitted directly from one compaction apparatus to another. However, a control center can also be used. The area-specific compaction nominal values can then be transmitted from this control center, preferably by radio, to the compaction apparatuses. The compaction apparatuses then themselves transmit the area-related compaction actual values. On the one hand, the control center can act as an intermediate "intelligence"; however, it can also be used to store the area-related compaction actual values and final values for record purposes, and for building-site management.

In addition to determination of compaction values (stiffness), other values such as the surface temperature and the ground damping can, of course, additionally also be determined.

The following explanation of the method for measurement of the compaction actual values is based on the use of so-called vibration plates. The procedure for any compaction apparatus is analogous to this.

For absolute measurement, an excitation force which varies over time is produced on the vibration unit as a periodic first force with a maximum first oscillation value directed at right angles to the ground surface. The frequency of the excitation force and/or its period are/is set or adjusted until an oscillating system, formed from the vibration unit and a ground area to be compacted or to be measured and with which the vibration unit makes continuous surface contact starts to resonate. The resonant frequency f is recorded and stored. Furthermore, a phase angle $\phi$ is determined between the occurrence of a maximum oscillation value of the excitation force and a maximum oscillation value of an oscillation response of the oscillating system mentioned above.

If, for example, a vibration plate is being used, then the oscillating mass $m_d$ of the lower body is known, and a static moment $m_d$ of an unbalanced exciter is also known, in which case all of the oscillating unbalances must be taken into account. The amplitude A of the lower body is measured, in addition to the phase angle $\phi$. The following relationship allows the absolute ground stiffness $k_B$[MN/m] to be determined from the oscillating mass $m_d$[kg·m], the resonant frequency f [Hz], the static moment $M_d$[kg·m], the amplitude A[m] and the phase angle $\phi$[°]:

$$k_B=(2\cdot\pi\cdot f)^2\cdot(m_d+\{M_d\cdot\cos\phi\}/A) \quad \{A\}$$

A modulus of elasticity of the relevant piece of ground can be determined using the following formula from the determined ground stiffness $k_B$ (which applies to both absolute and relative values):

$$E_B[MN/m^2]=k_B\cdot\text{form factor}$$

The form factor can be determined by continuum-mechanical analysis of a body which is in contact with an elastic semi-infinite area, in accordance with "Forschung auf dem Gebiet des Ingenieurwesens" [Research in the field of engineering], volume 10, September/October 1939, No. 5, Berlin, pages 201 to 211, G. Lundberg, "Elastiche Berührung zweier Halbräume" [Elastic contact between two half-spaces].

In order to determine relative values, with this being a rapid method, the excitation force is increased until the vibration unit starts to jump. In addition, the excitation force is now no longer allowed to act at right angles to the ground surface but such that the apparatus is moved automatically over the ground surface, together with the vibration unit (this applies in particular to the vibration plate) and now just needs to be driven in the desired direction by a vibration-plate operator. In this case, the measurement means for the apparatus are designed such that a frequency analysis of the oscillation response is just carried out adjacent to the vibration plate. A lowest subharmonic oscillation with respect to the excitation frequency is determined using filter circuits. The lower the lowest subharmonic oscillation is, the greater is the ground compaction achieved. The measurement can be further refined by determining amplitude values in the oscillation response for all subharmonic oscillations, as well as a first harmonic of the excitation frequency. These amplitude values are related to the amplitude of the excitation frequency, using weighting functions, using the following equation:

$$s=x_0\cdot A_{2f}/A_f x_2\cdot A_{f/2}/A_f+x_4\cdot A_{f/4}/A_f+x_8\cdot A_{f/8}/A_f \qquad \{B\}$$

$x_0$, $x_2$, $x_4$ and $x_8$ are weighting factors whose determination is described below. $A_f$ is the maximum oscillation value of the excitation force acting on the vibration unit. $A_{2f}$ is the maximum oscillation value of a first harmonic of the excitation oscillation. $A_{f/2}$ is a maximum oscillation value of a first subharmonic at half the frequency of the excitation oscillation. $A_{f/4}$ and $A_{f/8}$ are maximum oscillation values of a second and third subharmonic, respectively, at a quarter of the frequency and at one eighth of the frequency, respectively, of the excitation oscillation. $A_{2f}$, $A_{f/2}$, $A_{f/4}$ and $A_{f/8}$ are determined from the oscillation response.

The greater the value of s is, the greater is the ground compaction as well. Since all that is necessary for assessment of the ground compaction is to determine the maximum oscillation values and their relationships, with a sum being formed, this is an extremely rapid measurement method.

If the weighting values as stated above are now determined, then an absolute measurement follows from the relative measurement, with the process of obtaining absolute values always being linked to one and the same ground composition (clay, sand, gravel, clay soil with a predetermined gravel/sand component, . . . ).

If measurements are carried out after each compaction process, for example by a trench roller, by a roller train etc., then any compaction increase can be determined. If the compaction increase is only minor or no compaction increase is found, driving over the area again will not increase the compaction any further. If a further compaction increase is nevertheless required, different compactor means must be used, or the ground composition must be changed by replacing the material.

Since the apparatus described here can be used to carry out not only absolute measurements but also rapid relative measurements of the ground compaction, it is possible, as stated in the following text, to also carry out rapid absolute measurements after calibration. On the basis of the above equation [A], the absolute ground stiffness $k_B$[MN/m] of a ground subarea can be determined from knowledge of the "machine parameters", the oscillating mass $m_d$ of the lower body and the static moment $M_d$ of an unbalanced exciter, if a vibration plate is used, and measurement of the oscillation amplitude A of the lower body, the resonant frequency f [Hz] and the phase angle $\phi$[°].

Ground stiffness values $k_{B1}$, $k_{B2}$, $k_{B3}$ and $k_{B4}$ are now determined, in a corresponding manner to the four weighting factors $x_0$, $x_2$, $X_4$ and $x_8$ in equation {B}, on four different ground subareas of the ground area, with an absolute measurement in each case, and the same ground composition should result in different ground stiffnesses in this process.

Once the ground stiffness values $k_{B1}$, $k_{B2}$, $k_{B3}$ and $k_{B4}$ have been determined, the maximum oscillation values $A_f$, $A_{2f}$, $A_{f/2}$, $A_{f/4}$ and $A_{f/8}$ are determined on the same four ground subareas. The values obtained are substituted in equation {B}, using the ground stiffness values $k_{B1}$, $k_{B2}$, $k_{B3}$ and $k_{B4}$ for s. This results in four equations from which the four weighting factors that are still unknown can be determined.

If these values are stored in a memory or an evaluation unit for the apparatus described below, then all that is now necessary when driving over the ground subareas is to determine the maximum oscillation values $A_f$, $A_{2f}$, $A_{f/2}$, $A_{f/4}$ and $A_{f/8}$ and to link them to the weighting values in order to obtain absolute ground stiffness values. An absolute measurement can now be carried out just as quickly as the relative measurements described above.

If the ground composition changes, then relative measurements can also be carried out; however, a recalibration process should be carried out. Weighting values for different ground compositions can be stored in a memory in the apparatus (in general, however, in a control center as mentioned below), and measurement can be carried out within a tolerance that is predetermined by the ground composition. However, a calibration should always be carried out, in order to obtain sufficient accuracy, when the ground compositions change. Calibration is admittedly considerably slower than the rapid relative measurement; however, with practice, a calibration can be carried out in a few minutes.

The determined ground compaction values are preferably transmitted together with the respective position co-ordinates of an area which is being measured, are stored and are at the same time transmitted to a control center such as a site office, in order to allow this data to be transmitted again from there via a transmitting and receiving unit to the relevant compaction apparatuses. However, as stated above, the data can also be stored for further processing in the compaction apparatus.

A vibration plate can preferably be used as the compaction apparatus, since this is a low-cost product. However, other machines such as a trench roller and roller train, can also be used. However, the vibration plate has the advantage that the contact area with the ground surface is defined.

Two unbalances driven in opposite senses are preferably used as the excitation force. The mutual position of the two unbalances must be adjustable with respect to one another in order on the one hand to ensure that the excitation force can be directed at right angles to the ground surface (for a calibration and an absolute measurement), and on the other hand can be directed inclined backwards in the opposite direction to the movement direction. The frequency of the excitation force (in this case by way of example, the contrarotating speed of revolution of the unbalances) must also be adjustable in order to allow resonance to be achieved. The resonant frequency can be searched for manually; however, this can also advantageously be done by an automatic "scanning" process, which starts to oscillate at the resonant frequency.

The static unbalance moment is formed, such that it can be adjusted automatically, by means of an adjustment unit in that, for example, the unbalance mass or masses can be moved radially.

The frequency of action on the ground contact unit can also be adjusted by means of the adjustment unit. If the frequency is adjustable, resonance of the oscillating system comprising the ground contact unit and the ground area to be compacted or being compacted can be determined. Operation at resonance results in compaction with less compaction power. Since the oscillating system is a damped system because of the compaction power to be applied, the degree of damping results in a phase angle between the maximum amplitude of excitation (for example force produced by the rotating unbalance weight) and the oscillation of the system (=oscillation of the ground contact unit). In order to allow this phase angle to be determined, a sensor which measures the time deflection in the ground compaction direction is fitted to the ground contact unit in addition to a sensor for the subharmonics (and for the resonant frequency and harmonics). The time deflection of the excitation (force applied to the ground contact unit) can likewise be measured; however, this can easily be determined from the instantaneous position of the unbalance weight or weights. The timing of the maximum amplitudes (excitation oscillation for oscillation of the ground contact unit) is determined by means of a comparator. The excitation is preferably set such that the maximum amplitude of the excitation leads the maximum amplitude of the ground contact unit by 90° to 180°, preferably by 95° to 130°. The values determined in this case can be used, as stated below, to determine the absolute compaction values as well, if the excitation frequency is variable.

The maximum amplitude of the excitation force is preferably also adjustable. The excitation force can be adjusted, for example, when using two unbalance weights which rotate at the same speed of revolution and whose angular separation is variable. The unbalance weights may be moved in the same sense or else in opposite senses.

In addition, it should be noted that the occurrence of subharmonics can lead to machine damage if a ground compaction apparatus having a ground contact unit is not appropriately designed. Damping elements are therefore placed between the respective ground contact unit and the other machine parts in order to damp the transmission of subharmonics. The entire ground compaction unit can, of course, be designed such that the low-frequency subharmonics do not cause any damage; their frequency is in fact known on the basis of the statements in the detailed description. However, the amplitude of the excitation force can also be reduced to such an extent that the amplitudes of the subharmonics no longer cause damage, or are no longer present.

Further advantageous embodiments and feature combinations of the invention will become evident from the following detailed description and the totality of the patent claims.

BRIEF DESCRIPTION OF THE DRAWINGS

In the drawings which are used to explain the exemplary embodiment:

FIG. 9 shows a schematic illustration of a processing procedure which can be carried out using the system according to the invention, and FIG. 10 shows a schematic illustration of the system controller.

Fundamentally, identical parts are provided with the same reference symbols in the figures.

APPROACHES TO IMPLEMENTATION OF THE INVENTION

Figure 1:
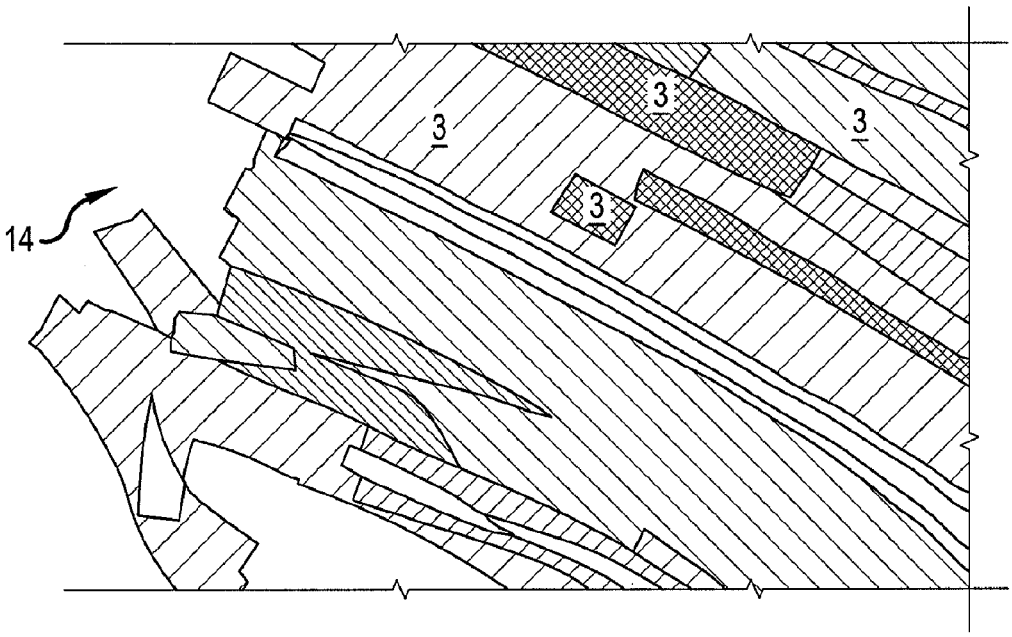
FIG. 1 shows an example of a terrain arrangement with differently compacted ground areas.

First of all, one example for the monitoring and control of the compaction work on a building site with a plurality of subareas TB1, TB2, TB3, TB4 that are physically at a distance from one another will be explained with reference to FIG. 9.

An absolute compaction value is measured as a calibration value E1(x1, y1) in the subarea TB1 using a calibration apparatus EV at a time t1 at the location whose position coordinates are x1, y1. The data is transmitted by radio from the calibration apparatus EV to the computation unit R, where it is stored. A compaction roller W1, which is moved to the subarea TB1 by the system controller, first of all measures the relative compaction value V(W1;TB1;x1,y1) at the point x1, y1, and transmits this value to the computation unit R. The computation unit R correlates the relative compaction value of the compaction roller W1 with the calibration value E1(x1, y1) and transmits the result, for example in the form of a correction factor K(W1,TB1)=corr. [E1(x1,y1)↔V(W1; TB1; x1,y1)], to the compaction roller W1, which can now compact the entire subarea TB1 to a predetermined absolute compaction value. During the process, it will transmit the actually achieved relative compaction values V(TB1,xi,yi; i=1 . . . n), which are also absolute compaction values because of the correlation with E1(x1, y1), preferably covering an area (that is to say in a predetermined area grid xi, yi, where the index i runs from 1 to n) to the computation unit R.

In addition, while the compaction roller W1 is working on the subarea TB1, a compaction roller W2 which has become free in the meantime can be moved to the point x1, y1 in order to drive over the ground there (at a time t2) in a non-compacting manner, and to measure a relative compaction value V(W2;TB1;x1,y1). This relative compaction value is transmitted to the computation unit R. If the point x1, y1 has not been worked on by the first compaction roller W1 at the time t2, the computation unit R correlates the compaction value obtained by the second compaction roller W2 directly with the calibration value E1(x1, y1), and transmits the calculated correction factor K(W2,TB1)=corr. [E1(x1,y1)↔V(W2;

TB1; x1,y1)] to the compaction roller W2. If, in contrast, the first compaction roller W1 has already compacted the point x1, y1 to the predetermined value, the computation unit correlates the relative compaction value obtained by the second compaction roller W2 with the compacted value V(W1;TB1, x1, y1; t2), that is to say with the compaction value after being worked on (=predetermined nominal value). Because the first compaction roller W1 continuously supplies the computation unit R with the compaction values V(W1;TB1,xi,yi; i=1 . . . n) achieved, the computation unit R is able to transmit the appropriate correction factor to the second compaction roller W2.

The second compaction roller W2 can then continue to the subarea TB2 and record the ground processing there. Because it has been calibrated by the measurement at the point x1, y1, it can determine position-related absolute compaction values V(W2;TB2,xi,yi; i=1 . . . n) in the subarea TB2, even if the calibration apparatus EV is not yet at that point. When the calibration apparatus arrives, it can check whether the required compaction value has been achieved at the predefined measurement point x2, y2. It is irrelevant whether the second compaction roller W2 is running or is stationary at this time, or where it is located. The calibration measurement can be carried out independently of this. The calibration apparatus EV in turn transmits the measured absolute compaction values E2(x2,y2) together with the position co-ordinates x2, y2 to the computation unit R. Since the computation unit R knows the measured values determined by the second compaction roller W2 in the subarea TB2, it can once again carry out a correlation process and check how well the second compaction roller W2 has been calibrated (on the basis of the measurement at the point x1, y1). It transmits the correction factor without delay to the compaction roller W2, which may already be working on the ground area TB4 at this time.

Finally, the calibration apparatus is moved to the third measurement position x3, y3 in the third subarea TB3. The absolute ground compaction can be determined here in the same way as that described for the subareas TB1 and TB2.

Calibrated measurements at different points are therefore available for the various subareas of the building site (in which case, of course, a plurality of measurements may also be taken for each subarea). The system can use these calibration points to calibrate the various compaction apparatuses, making it possible to take account of the location of the machines and the respective state of work in a highly flexible manner. There is therefore no longer any need for a calibration measurement to be carried out for a plurality of appliances and machine operators at the same time and at the same point. The distances traveled by the machines can be minimized. Time shifts which result from work that was not originally envisaged or from capacity changes (because more or less machine hours are available) can be taken into account in the system plan.

As the above example shows, the compaction values V(W1;TB1,xi,yi; i=1 . . . n) are stored together with an identification of the machine which has measured these values. The computation unit can therefore also carry out subsequent evaluations and, for example, can track the quality of the measurements by the various apparatuses.

FIG. 10 shows, schematically, the system controller. Each compaction roller W1, W2, the calibration apparatus EV and the computation unit R have a control unit CPU1, . . . , CPU4. These control units CPU1, . . . , CPU4 are connected to one another and carry out a programmed procedure. This stipulates, for example, what machine will record and transmit data, and at what time this should be done. Furthermore, it is possible to predetermine and control where the machines should move toward, to which machine the computation unit transmits what data, and much more.

Correlation of relatively measured compaction values with absolute measured values is always highly advantageous when the ground composition changes over a ground area to be measured and/or to be compacted. For example, the ground in the various ground areas may be sandy, clay, stony (pebbles or gravel); it may also have a different water content. All of these different ground compositions give different relative ground compaction values.

If the positions and contours of the areas of different ground composition are now known, then a calibration point with a measured absolute ground stiffness is predetermined in each of these ground areas. The various ground compaction apparatuses are then moved over this point, in order to correlate their relative ground compaction values with absolute values for the relevant areas.

FIG. 1 shows a terrain area 14 with a plurality of ground areas 3, running in tracks, with different compaction. The higher the compaction is in comparison to a compaction nominal value, the closer is the characterizing shading chosen here. A small box pattern indicates that the compaction achieved already corresponds to the compaction nominal value. The aim of the compaction process desired here, as is required by way of example for road construction, is to achieve a predetermined compaction level which must not be overshot or undershot. Uniform compaction is possible with acceptable effort only by means of the invention. By way of example, different shading has been chosen here in order to illustrate the compaction state; however, a display using different colors would preferably be chosen.

The compaction values for this terrain area are stored, for example, in the computation unit (they may also be stored in any compaction apparatus so that the compaction apparatus can operate autonomously even if the radio link to the central computation unit is temporarily interrupted). In addition, the geometry (layer thickness, number of layers applied) and material character (gravel, mixture, origin, etc.) can be stored in the data map.

Figure 2:
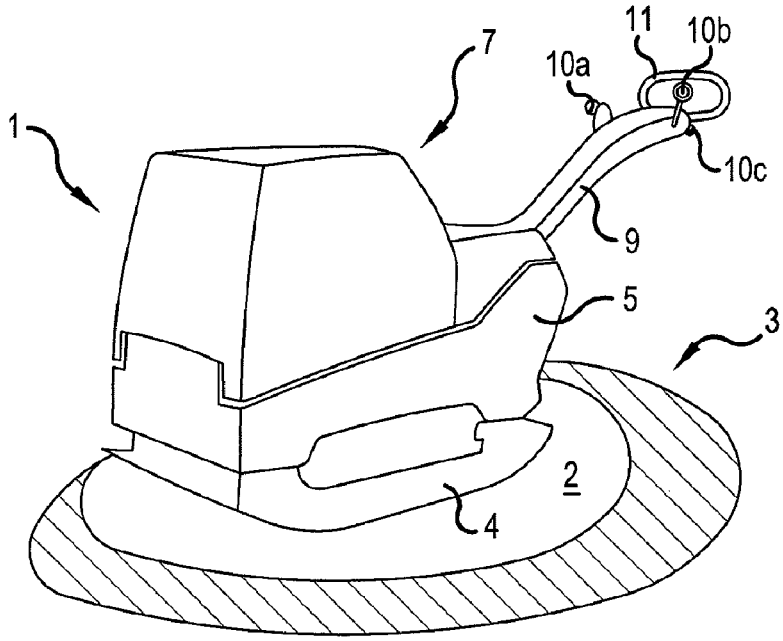
FIG. 2 shows a schematic illustration of a vibration plate for compaction of a ground area and measurement of the achieved compaction actual values.

By way of example, a vibration plate 1 is used as the compaction apparatus. The vibration plate 1 is therefore used as a compaction and measurement appliance. In general, it has a ground contact unit (lower body 5 with base plate 4) with two contrarotating unbalance weights 13*a* and 13*b* (FIG. 2) with a total mass $m_d$ which also includes an unbalanced energizer. $m_d$ symbolizes the total exciting oscillating mass. A static load weight from the upper body 7 is supported on the lower body 5 with a mass $m_f$ (static weight) via damping elements 6 (stiffness $k_G$, damping $c_G$). The static weight $m_f$ together with the damping elements 6 results in an oscillating system which is excited at the base point and is tuned to be low (low natural frequency). The upper body 7 acts as a second-order low-pass filter for the oscillations of the lower body 5 during vibration operation. This minimizes the vibration energy transmitted to the upper body 7.

The ground to be measured, to be compacted or being compacted in the ground area 3 is a substance for which different models exist, depending on the characteristics being investigated. For the case of the system mentioned above (ground contact unit-ground), simple spring-damper models (stiffness $k_B$, damping $c_B$) are used. The spring characteristics take account of the contact zone between the ground compaction unit (lower body 5) and the elastic half-space (ground area). In the region of the excitation frequencies of the appliance mentioned above, which are above the lowest natural frequency of the system (ground contact unit-ground), the ground stiffness $k_B$ is a static, frequency-independent variable. It was possible to verify this characteristic in the application proposed here in the field trial for homogeneous and layered ground strata.

If the appliance and ground model is collated taking account of the link on one side into an overall model, the following equation system (1) describes the associated differential equations of motion for the degrees of freedom $x_d$ of the lower body 5 and $x_f$ of the upper body 7.

$$m_d\ddot{x}_d+F_B+c_G(\dot{x}_d-\dot{x}_f)+k_G(x_d-x_f)=M_d\Omega^2\cos(\Omega\cdot t)+m_dg$$

$$m_f\ddot{x}_f+c_G(\dot{x}_f-\dot{x}_d)+k_G(x_f-x_d)=m_fg \quad (1)$$

On the basis of the link on one side, which is controlled by the ground force, this results in:

$$F_B=c_B\dot{x}_d+k_Bx \text{ for } F_B>0$$

$$F_B=0 \text{ else}$$

$m_d$: oscillating mass [kg], for example lower body 5
$m_f$: stat. load weight [kg] for example upper body 7
$M_d$: stat. moment unbalance [kg m]
$x_d$: movement of oscillating mass [mm]
$x_f$: movement of load weight [mm]
$\Omega$: excitation circular frequency [$s^{-1}$] $\Omega=2\pi\cdot f$
f: excitation frequency [Hz]
$k_B$: stiffness of the ground underneath/of the ground area [MN/m];
$c_B$: damping of the ground underneath/of the ground area [MNs/m]
$k_G$: stiffness of the damping elements [MN/m]
$c_G$: damping of the damping elements [MNs/m]

A ground reaction force $F_B$ between the lower body 5 and the ground area 3 to be measured, being compacted or to be compacted in this case controls the non-linearity of the one-sided link.

The analytical solution of the differential equations (1) is in the following, general form:

$$x_d=\sum_j A_j\cos(j\cdot\Omega\cdot t+\varphi_j) \quad (2)$$

j=1 linear oscillation response, load operation
j=1, 2, 3, . . . periodic lifting off (the machine loses contact with the ground once in each excitation period)
j=1, ½, ¼, ⅛, . . . and associated harmonics: jumping, tumbling, chaotic operating state.
$\phi$ is a phase angle between the occurrence of a maximum oscillation value of the excitation force and a maximum oscillation value of an oscillation response of the oscillating system mentioned above.

For the following analysis of "jumping", a force $F_B$ acting at right angles to the ground surface 2 is assumed. In the case of the vibration plate described above, in contrast, this force does not act at right angles to the ground surface 2, but at an angle to the rear in order, for example, to produce a jumping movement in the forward direction. The vertical component of the angled force must therefore be used in the following mathematical analyses. The excitation force which acts at an angle to the ground surface is achieved by shifting the unbalance weights 13*a* and 13*b*, which rotate in opposite senses with respect to one another, such that their additive unbalance moments for the unbalance weights 13*a* and 13*b* result in a maximum force vector approximately at an angle of 20° downwards to the right in FIG. 3. In order to determine the absolute values (resonance), the maximum force vector (which will be identical to $F_B$) points vertically toward the ground surface 2.

The solutions to the equations (1) can be calculated by numerical simulation. The use of numerical solution algorithms is essential, in particular for verification of chaotic oscillations. Very good approximate solutions and statements of the fundamental nature relating to bifurcation of the fundamental frequencies can be made for linear and non-linear oscillations by the use of analytic calculation methods, such as the averaging method. Averaging theory is described in Anderegg Roland (1998), "Nichtlineare Schwingungen bei dynamischen Bodenverdichtern" [Non-linear oscillation in dynamic ground compactors], VDI progress reports, Series 4, VDI Verlag Düsseldorf. This allows a good general overview of the solutions that occur. Analytical methods are associated with an unreasonably high degree of complexity for systems with a plurality of branches.

The Mathlab/Simulink® program pack is used as a simulation tool. Its graphics user interface and the available tools are highly suitable for dealing with the present problem. The equations (1) are first of all transformed to a non-dimensional form in order to achieve results whose general validity is as good as possible.

$$\text{Time: } \tau=\omega_0t;\omega_0=\sqrt{k_B/m_d}$$

Resonance ratio:

$$\kappa=\frac{\Omega}{\omega_0} \text{ where } \Omega=2\pi\cdot f$$

i.e. where $K=f/f_0$ where f is the excitation frequency and $f_0$ the resonant frequency [Hz].
$\omega_0$ is the circular resonant frequency of the "machine-ground" oscillating system [$s^{-1}$].
Location:

$$\eta=\frac{x_d}{A_0};$$

$$\varsigma=\frac{x_f}{A_0};$$

$$\eta''=\omega_0^2\eta;$$

$$\varsigma''=\omega_0^2\varsigma;$$

amplitude $A_0$f is freely variable.
Material characteristics:

$$\delta=\frac{c_B}{\sqrt{m_dk_B}}=2d_B;$$

$$\lambda_c=\frac{c_G}{c_B};$$

$$\lambda_k=\frac{k_G}{k_B};$$

Masses and forces:

$$\lambda_m=\frac{m_f}{m_d}; \quad (3)$$

-continued $$A_{th} = \frac{m_u r_u}{m_d};$$

$$\gamma = \frac{A_{th}}{A_0};$$

$$f_B = \frac{F_B}{k_B \cdot A_0} = k_B A_0(\eta + \delta\eta');$$

$$\eta = \frac{x_d}{A_0};$$

$$\eta_0 = \frac{m_d \cdot g}{k_B A_0};$$

$$\varsigma_0 = \frac{m_f \cdot g}{k_B A_0};$$

$$n'' + f_B + \lambda_c \delta(\eta' - \varsigma') + \lambda_k(\eta - \varsigma) = \gamma\kappa^2 \cos(\kappa\tau) + \eta_0$$

$$\lambda_m \varsigma'' + \lambda_c \delta(\varsigma' - \eta') + \lambda_k(\varsigma - \eta) = \varsigma_0$$

where:

$$f_B = \begin{cases} \delta\eta' + \eta & \text{if } f_B > 0 \\ 0 & \text{else} \end{cases}$$

Figure 4:
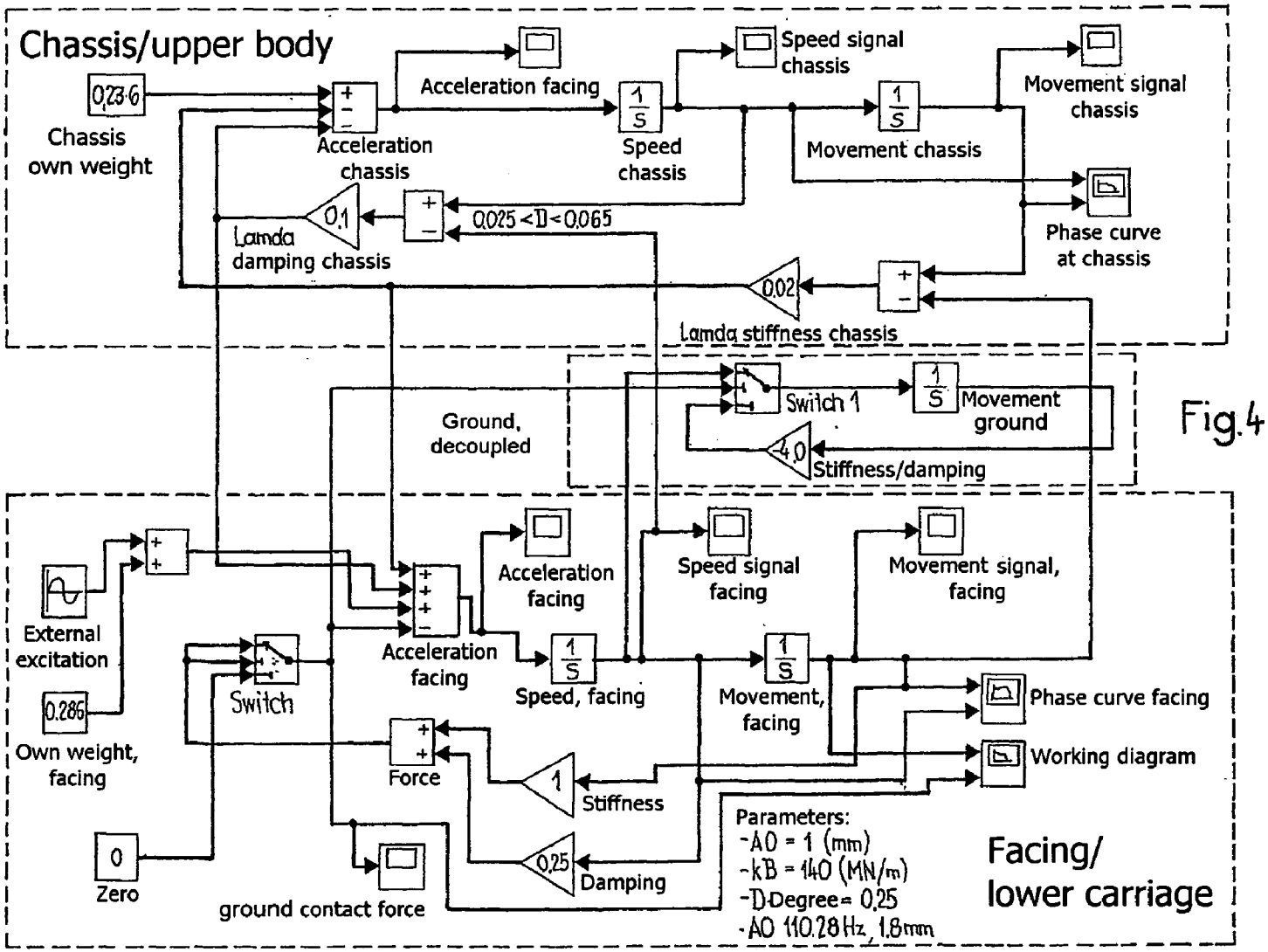
FIG. 4 shows an example of the implementation of a non-dimensional model in a Simulink model.

The resultant equations (3) are modeled graphically using Mathelab Simulink®, see FIG. 4. The non-linearity is considered in a simplified form as a purely force-controlled function, and is modeled using the "Switch" block from the Simulink library.

The co-ordinate system used in equations (1) and (3) includes a static lowered area resulting from the natural weight (static load weight $m_f$, oscillating mass $m_d$). In comparison with measurements which result from the integration of acceleration signals, the static lowered area must be subtracted for comparison purposes in the simulation result. The initial conditions for the simulation are all set to "0". The results are quoted for the steady state. "ode 45" (Dormand-Price) with a variable integration step width (max. step width 0.1 s) is chosen in the time period from 0 s to 270 s as the solution solver.

It is generally sufficient for analysis of the chaotic machine response of the vibration plate 1 to investigate the oscillating part. Particularly in the case of well-matched rubber damper elements, the dynamic forces in the elements (lower body and upper body) are negligibly small in comparison to the static forces and $\ddot{x}_f \ll \ddot{x}_d$ applies. In this case, the two equations (1) and (3) can be added, resulting in an equation (4a) for one degree of freedom of the oscillating element $x_d \equiv x$. The associated analytical model is shown in FIG. 3.

$$F_B = -m_d\ddot{x} + M_d\Omega^2 \cos(\Omega \cdot t) + (m_f + m_d) \cdot g \tag{4a}$$

Figure 3:
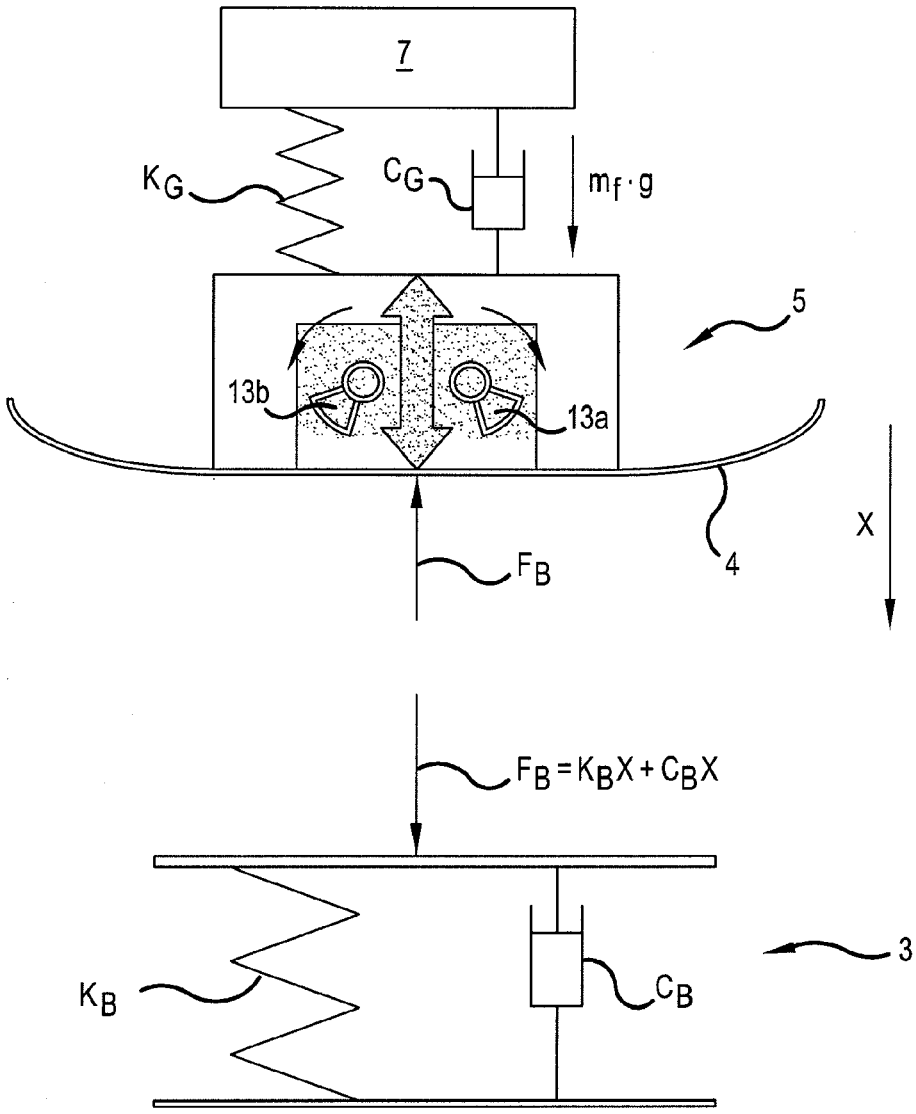
FIG. 3 shows details relating to calculation of ground compaction from a coupled system ground apparatus which can oscillate.

$F_B$ is the force acting on the ground area; see FIG. 3. This conventional second-order differential equation is rewritten to form the two following first-order differential equations:

$$\dot{x}_1 = x_2$$

$$\dot{x}_2 = -\frac{F_B}{m_d} + A_0\Omega^2 \cos(\Omega \cdot t) + \left(1 + \frac{m_d}{m_f}\right) \cdot g$$

where $$A_0 = \frac{M_d}{m_d}$$

and $$F_D = c_B \dot{x}_d + k_b x \quad \text{for} \quad F_B > 0$$

$$F_B = 0 \quad \text{else}$$

as the ground-force-controlled non-linearity.

In this case: $x_2 \equiv \dot{x}$.

A phase-space representation using $x_1(t)$-$x_2(t)$, and $x(t)$-$\dot{x}(t)$ is derived from this.

The phase curves, also referred to as orbitals, are closed circles or ellipses in the case of linear, steady-state and single-frequency oscillations. In the case of non-linear oscillations, in which harmonics additionally occur (periodic lifting of the facing from the ground), the harmonics can be seen as modulated periodicities. Only in the case of period doublings, that is to say subharmonic oscillations such as "jumping" does the original circle mutate into closed curve trains which have intersections in the phase-space representation.

It has been found that the occurrence of subharmonic oscillations in the form of branches or bifurcations is a further, central element of highly non-linear and chaotic oscillations. In contrast to harmonics, subharmonic oscillations represent a new operating state, which must be dealt with separately, of a non-linear system; this operating state is highly different from the original, linear problem. This is because harmonics are small in comparison to the fundamental, that is to say the non-linear solution to the problem remains, mathematically speaking, in the vicinity of the solution of the linear system.

Figure 5:
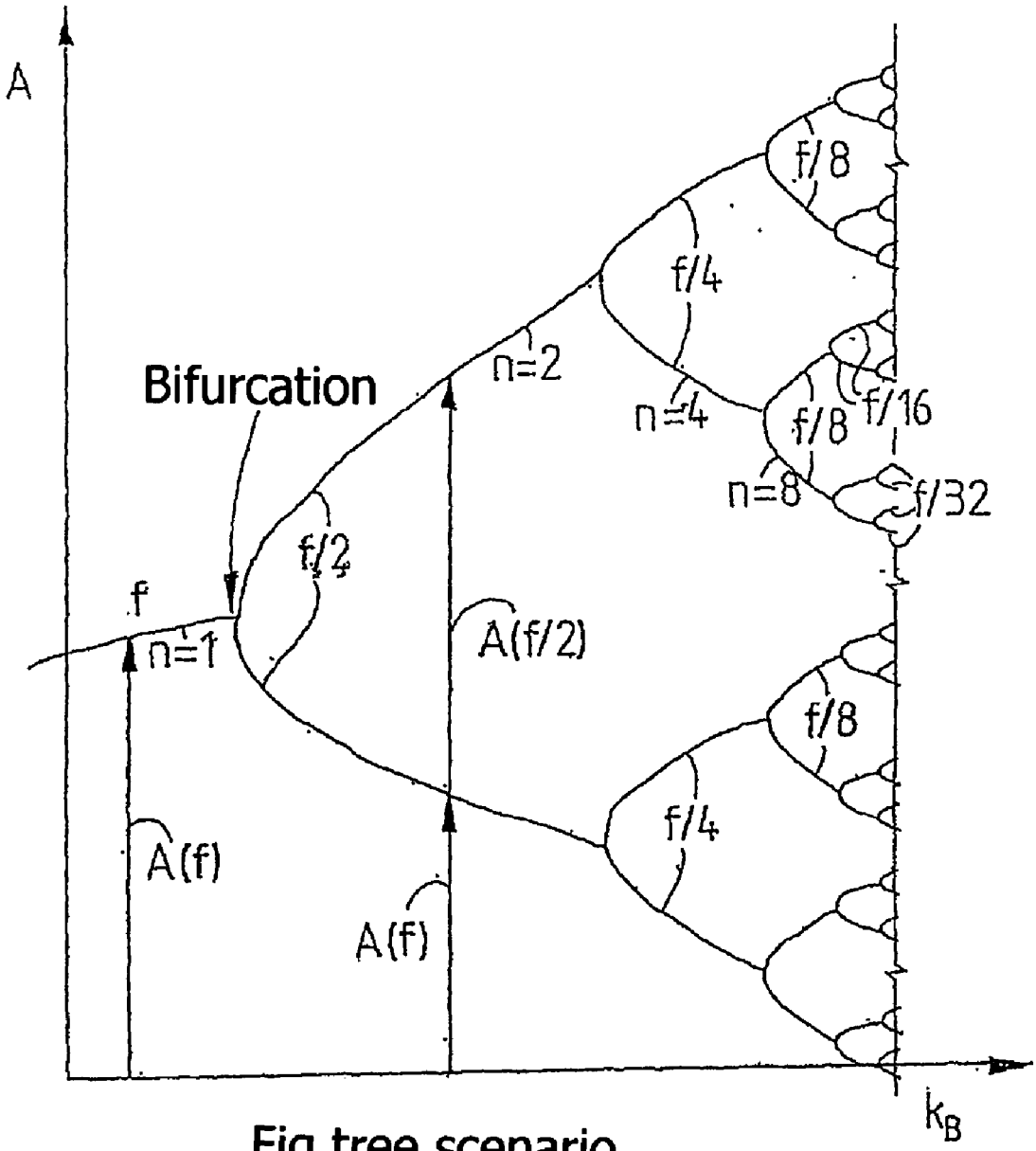
FIG. 5 shows a movement response of a vibration plate, with the machine parameters remaining unchanged, over the ground underneath of different hardness.

In practice, measured value recording can be initiated by the pulse from a Hall probe which detects the zero crossing of the vibro-wave. This also allows Poincaré maps to be generated. If the periodically recorded amplitude values are plotted as a function of the varied system parameter, that is to say in our case the ground stiffness $k_B$, this results in the bifurcation or so-called fig tree diagram (FIG. 5). This diagram shows, on the one hand, the characteristic of the amplitudes which suddenly become larger in the region of the branch when the stiffness is increasing, with the tangent to the associated curve or curves running vertically at the branch point. In consequence, in practice there is no need to supply any additional energy to make the roller jump, either. The diagram also shows that, when the stiffness is rising (compaction), further branches occur, to be precise at ever shorter intervals with respect to the continuously increasing stiffness $k_B$. The branches produce a cascade of new oscillation components, each at half the frequency of the previously lowest frequency in the spectrum. Since the first branch splits off from the fundamental at the frequency f, or period T, this results in the frequency cascade f, f/2, f/4, f/8, etc. The subharmonic are also generated analogously to the fundamental, resulting in a frequency continuum in the low-frequency range of the signal spectrum. This is likewise a specific characteristic of the chaotic system, that is to say in the present case of the vibrating vibration plate.

It should be noted that the system of the compaction appliance is in a deterministic state and not in a stochastic chaotic state. Since the parameters which cause the chaotic state cannot all be measured (cannot be observed completely), the operating state of the subharmonic oscillations cannot be predicted for practical compaction. In practice, the operating response is also characterized by a large number of unpredictable factors, the machine can slide away as a result of major loss of contact with the ground, and the load on the machine becomes very high as a result of low-frequency oscillations. Further bifurcations of the machine response can occur all the time (unexpectedly) resulting immediately in major additional loads. High loads also occur between the facing and the ground; this leads to undesirable loosening of layers close to the surface, and results in grain destruction.

In the case of new appliances whose machine parameters are actively controlled as a function of measured variables (for example ACE: Ammann Compaction Expert), the unbalance and therefore the power supply are reduced immediately when the first subharmonic oscillation occurs at the frequency f/2. This measure reliably prevents the undesirable jumping or tumbling of the facing. Furthermore, force-controlled regulation of the amplitude and frequency of the compaction appliance guarantees control of the non-linearity and thus reliable prevention of jumping/tumbling which, in fact and in the end, is the consequence of non-linearity occurring.

Owing to the fact that the subharmonic oscillations in each case represent a new state of motion of the machine, relative measurements, for example for recording of the compaction state of the ground, would need to be recalibrated for every newly occurring subharmonic oscillation with respect to the reference test procedure, such as the pressure-plate trial (DIN 18 196). There is no need for this relevant measurement, as will be explained below.

In the case of a "compactometer", in which the ratio of the first harmonic 2*f* to the fundamental f is used for compaction monitoring, the correlation changes fundamentally when jumping occurs; a linear relationship between the measured value and the ground stiffness exists only within the respective branch state of the motion.

If the machine parameters are left constant, the cascade-like occurrence of bifurcations and harmonics with their associated period doublings can be used analogously to large rollers as an indicator of increasing ground stiffness and compaction (relative compaction monitoring).

While rollers, from a roller train to a manually controlled trench roller, use the rolling movement of the facings for their onward movement and there is therefore no direct relationship between vibration and forward movement, the vibration plate is always caused to periodically lift off the ground for its forward movement, controlled by the inclination of its direction oscillator. The vibration and the forward movement are therefore directly coupled to one another, and the plates and stampers in consequence always have a non-linear oscillation response. In consequence, as the stiffness $k_B$ increases, these appliances enter the area of the period doubling scenario more quickly, and chaotic operating states occur more frequently with them than in the case of rollers.

The sensor for recording the oscillation form of the oscillating system is arranged according to the above description on the lower body 5 or on the upper body 7. If arranged on the upper body 7, oscillation influences caused by the damping elements, as sketched above, cannot be ignored.

Figure 6:
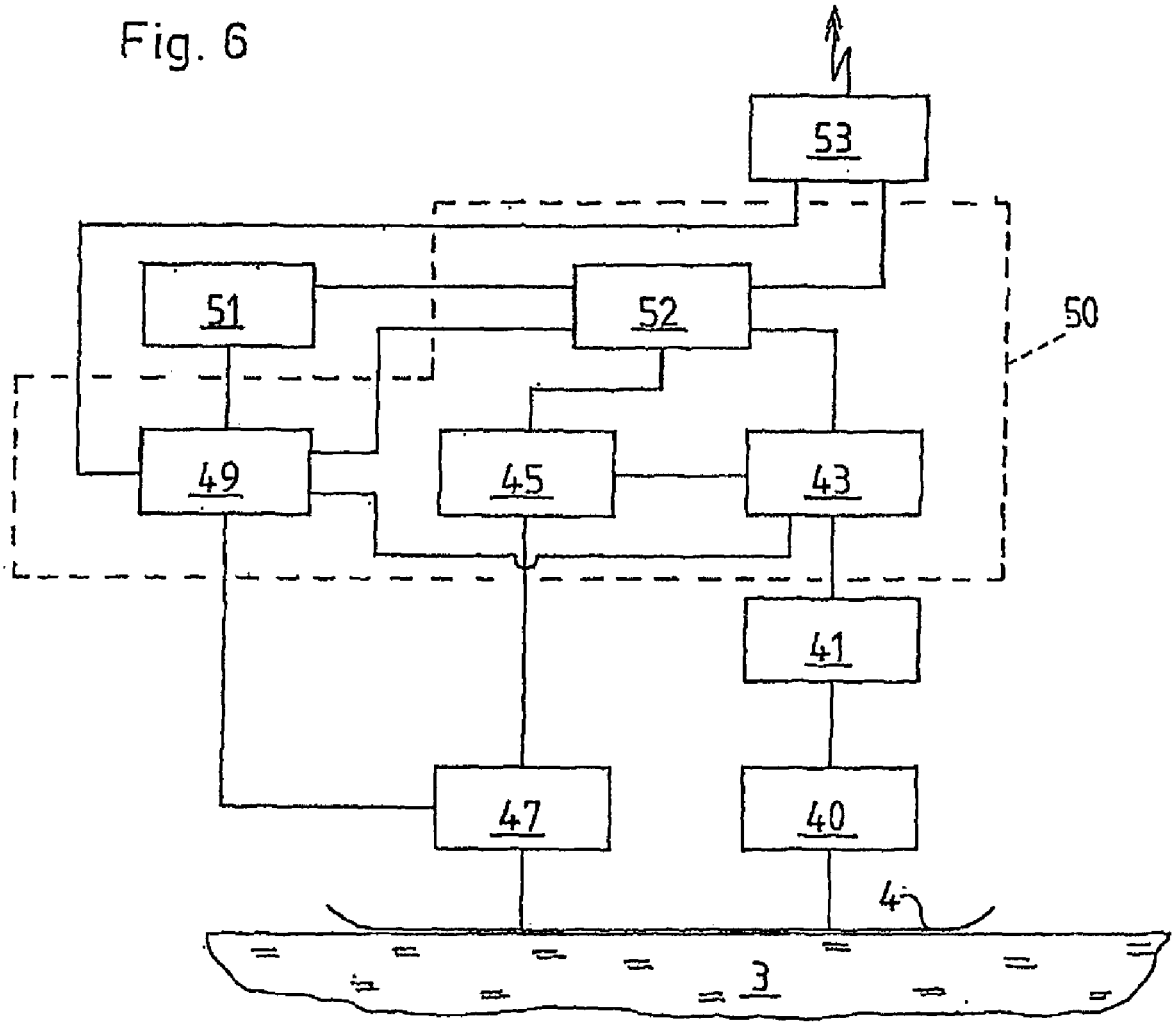
FIG. 6 shows a block diagram of one embodiment variant of the compaction apparatus according to the invention.

The apparatus 1 which can be moved over its ground area 2 in order to compact at least a ground area 3 in this case, by way of example, has an unbalance unit 40, an adjustment unit 41, a timer 43, a comparator unit 45, a measurement unit 47, a storage unit 49, a position-finding unit 51 and a transmitting and receiving unit 53. These functional blocks are illustrated schematically in FIG. 6.

The unbalance unit 40 has an adjustable unbalance moment and an adjustable unbalance frequency. The adjustment or setting is carried out by means of an adjustment unit 41, which is mechanically connected to the unbalance unit 40. The position-finding unit 51 is connected for signaling purposes to the storage unit 49. The position-finding unit determines the position of the ground area 3 that is currently being compacted. The position, that is to say the position co-ordinates, can be determined trigonometrically by direction finding or by means of GPS. The measurement unit 47 is in this case, by way of example, arranged on the base plate 4 and is connected for signaling purposes to the comparator unit 45 and to the storage unit 49. On the basis of the above statements, the measurement unit 47 automatically determines the compaction actual value of the ground area 3 while it is being compacted. This ground compaction value is stored together with the position co-ordinates, as determined by the position-finding unit 51, as the area-specific compaction actual value in the storage unit 49. The comparator unit 45 is used to compare the respective area-specific compaction actual value with an associated area-specific compaction nominal value, in order to obtain area-specific unbalance values or unbalance frequency values, corrected by the adjustment unit 41, for subsequently driving over the area for compaction purposes. The comparator unit 45 is connected for signaling purposes to the measurement unit 47, to the storage unit 49 and to the timer 43.

The computation unit 50 contains the timer 43, the comparator unit 45, the storage unit 49 and a central processing unit 52. The computation unit 50 is also connected to the transmitting and receiving unit 53, and to the position-finding unit 51. The computation unit 50 carries out all the calculations to set the corresponding machine data for optimum compaction, using stored and transmitted data. It also makes the data available for transmission to a control center or to other compaction apparatuses.

The timer 43 is used by the adjustment unit 41 to make the values available at the correct time for adjustment of the unbalance moment and unbalance frequency. In this case, in particular, masses must be moved, accelerated and braked. This requires time. The timer must therefore determine the setting values from the movement direction and movement speed, in advance.

The data receiving and transmitting unit 53 is used to receive area-specific compaction nominal values, in particular to receive area-specific compaction actual values from a previous compaction process. Furthermore, the data receiving and transmitting unit 53 is used to transmit the position of areas and their compaction actual values determined during compaction. The data receiving and transmitting unit 53 is connected for signaling purposes to the storage unit 49, from which a signaling link is then established to the comparator unit 45, to the measurement unit 47 and, via the timer 43, to the adjustment unit 41.

The compaction process as described above has been explained, merely by way of example, on the basis of a vibration plate. Any types of rollers and stampers may, of course, be used instead of the vibration plate.

In the case of a vibration plate, the direction of travel adjustment unit is provided just by operation of the guide shaft 9. For some types of roller, the direction of travel is generally set by means of a steering wheel.

Figure 7:
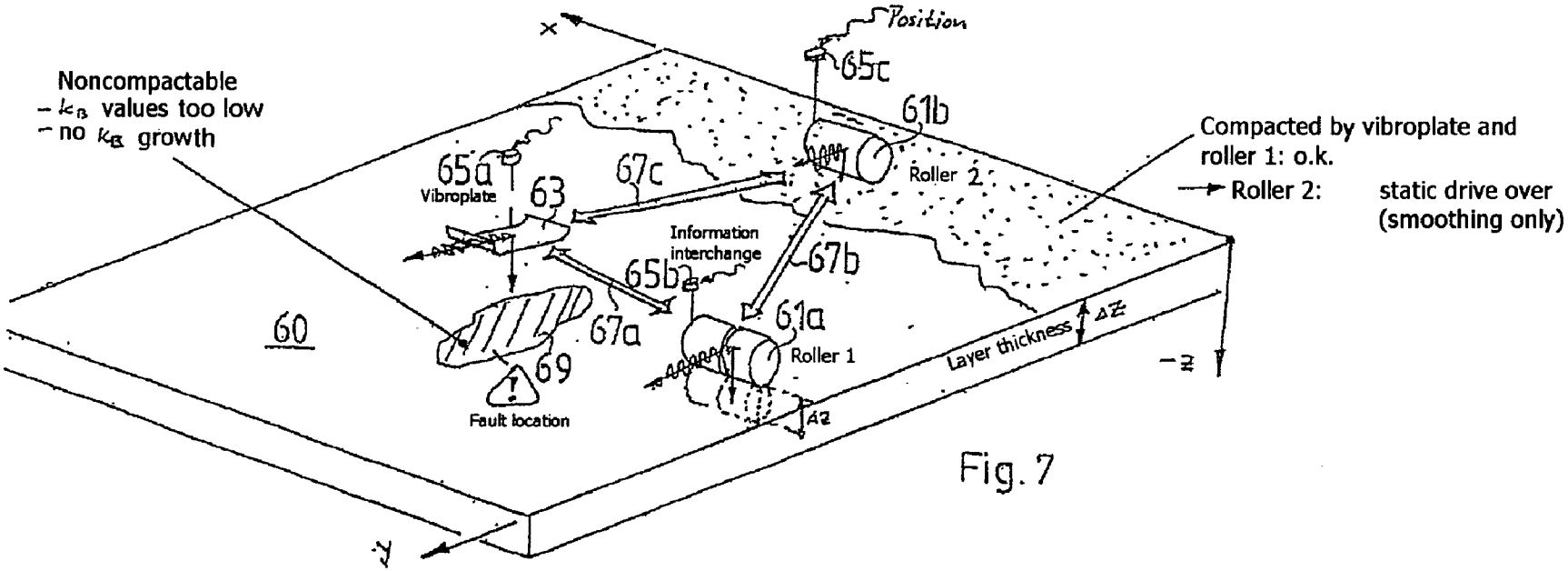
FIG. 7 shows a schematic illustration of an appliance arrangement with a plurality of compaction apparatuses.

Analogously to the terrain area 14, FIG. 7 shows a terrain section 60 which is to be compacted and is intended to be compacted using two schematically illustrated rollers 61*a* and 61*b* and the vibration plate 63. The rollers 61*a* and 61*b* as well as the vibration plate 63 each have a position-finding unit 65*a* to 65*c*. The communication between these three apparatuses 61*a*, 61*b* and 63 for data transmission of the respective area-specific compaction actual values takes place from each apparatus to each apparatus, indicated schematically by the double-headed arrows 67*a*, 67*b* and 67*c*. As a further illustration, the terrain section 60 includes a fault 69 as an area which cannot be compacted. One of the three apparatuses 61*a*, 61*b* and 63 will attempt to compact this fault 69 and will then detect an area-specific compaction actual value which is below the area-specific compaction nominal value. This compaction actual value is transmitted with the corresponding position to the two other apparatuses, and is stored in the apparatus currently carrying out the compaction process. The same apparatus or one of the other apparatuses will now find during a compaction process following this that, during a further compaction process, the area-specific compaction actual value has not increased within a predetermined tolerance value. This fault 69 will now be excluded, as not being possible to compact, that is to say it will no longer be driven over, during further compaction drives over the area. If it is impossible to exclude this area from being driven over, since it would otherwise not be possible to drive over adjacent areas for compaction purposes, then this fault 69 is driven over at an increased speed and with the compaction power reduced (just smoothing of the surface). An analogous procedure is used for areas which have already reached the predetermined area-specific compaction actual value.

Figure 8:
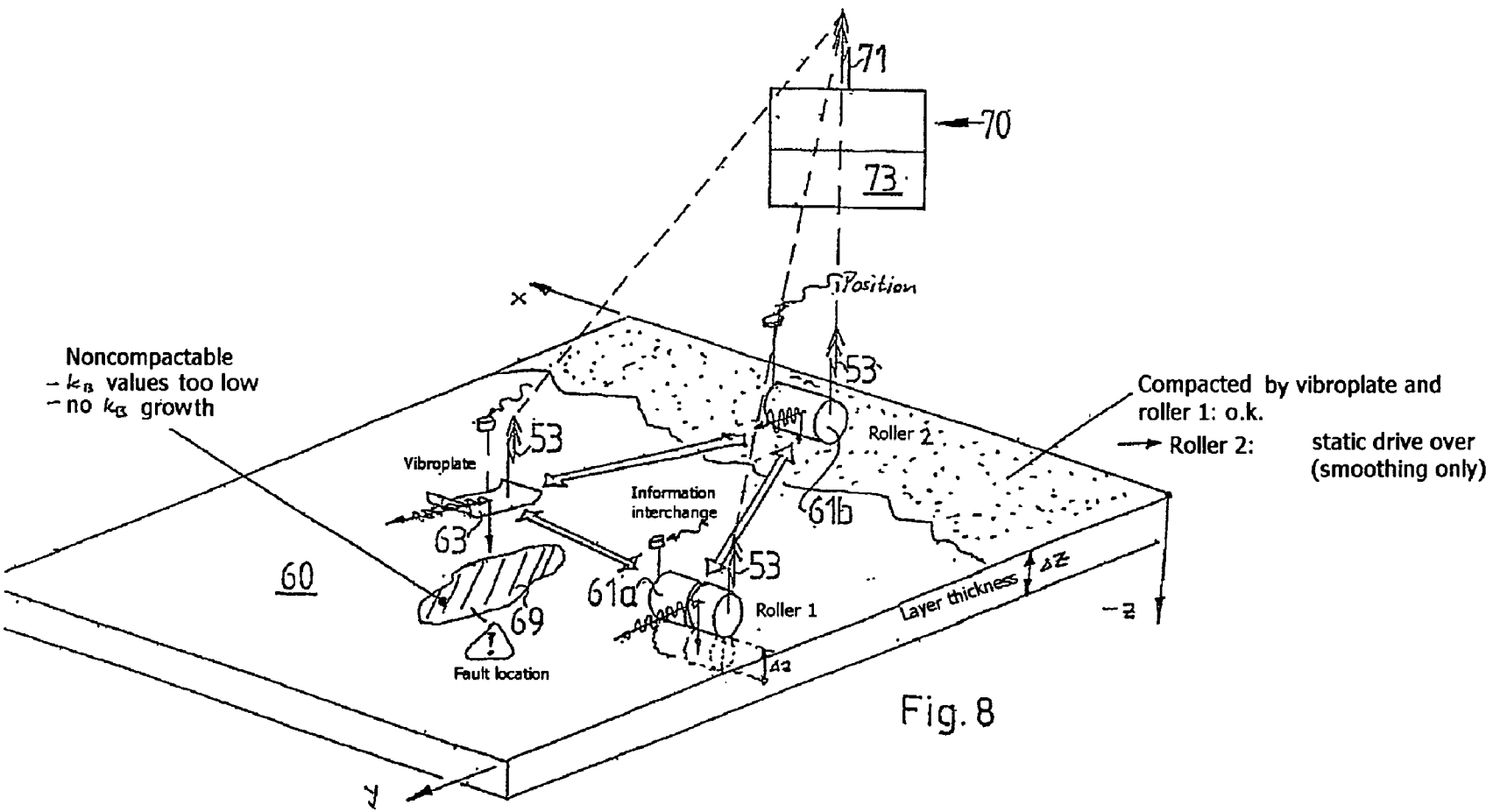
FIG. 8 shows a schematic illustration, analogous to FIG. 7, of an appliance arrangement with a plurality of compaction apparatuses and a control center for data transmission and data evaluation.

FIG. 8 shows a modification of the appliance arrangement illustrated in FIG. 7. In FIG. 8, there is a control center 70 by means of which all the compaction apparatuses, in this case likewise by way of example the vibration plate 63 and the two rollers 61*a* and 61*b*, communicate with one another via their data receiving and transmitting unit 71. The control center 70 will generally be the so-called site office in which all the information is gathered. The compaction apparatuses 61*a*, 61*b* and 63 then transmit the area-specific compaction actual values, which are gathered and evaluated appropriately in a data store 73, to this control center 60. Analogously to FIG. 1 (but with considerably more uniform compaction values), a terrain area from which the achieved compaction values can then be seen is then created in the control center 60. The fault 69 would be clearly evident in a display such as this. The control center 60 would then take measures, for example by replacing the ground material there.

In the above description, ground areas have been compacted. However, coverings applied to a ground area, such as asphalt coverings, can also be compacted in an analogous procedure using the same compaction apparatuses.

In summary it can be stated that the invention has provided a system which opens up new capabilities for efficient building-site management.

The invention claimed is:

1. A system for co-ordinated ground processing, comprising a) a plurality of compaction apparatuses for ground compaction, with the compaction apparatuses being designed to determine position-related relative compaction values of at least one position in a subarea based on a predetermined area grid, b) a calibration apparatus for determination of position-related absolute compaction values of said at least one position, c) a computation unit for correlation of relative and absolute position-related compaction values, with the compaction apparatuses, calibration apparatus and computation unit being connected to one another for information transmission purposes, and d) a system controller which is designed such that the position-related relative compaction values of the compaction apparatuses and the position-related absolute compaction values are transmitted continuously to the computation unit, are stored therein and, if compaction values of said one position are already present, compaction correlation values are calculated, are transmitted to the compaction apparatuses and are stored therein as a correction value.

2. The system as claimed in claim 1, wherein the system controller is designed such that each compaction apparatus is allocated an identification, and in that position-related relative compaction values are stored together with the identification in the computation unit.

3. The system as claimed in claim 1, wherein the computation unit is designed to store a ground area map.

4. The system as claimed in claim 1, wherein the computation unit is designed to link a position-related relative compaction value with characteristic values of a processed ground layer.

5. The system as claimed in claim 1, wherein the calibration apparatus and compaction apparatus are equipped with a GPS appliance for position-finding.

6. The system as claimed in claim 1, wherein the calibration apparatus is in the form of a compaction apparatus, in particular a compaction roller.

7. The system as claimed in claim 1, wherein the system has a plurality of compaction apparatuses without calibration apparatuses.

8. A method for compaction of at least one ground area by utilizing a compaction apparatus, the method comprising:

applying a predetermined area-specific compaction nominal value to said ground area;

determining position co-ordinates of each said ground area while being driven over for a first time;

automatically setting compaction value which corresponds to the area-specific compaction nominal value;

automatically determining an area-specific compaction actual value while being driven over and being compared automatically with the area-specific compaction nominal value;

readjusting the compaction value based on the area-specific compaction actual value and storing said readjusted value together with the position co-ordinates;

transmitting said readjusted value together with the position co-ordinates to at least one of a further compaction apparatus and at least one control center, and with at least one of area-specific compaction actual values while previously having been driven over and compaction nominal values being received by at least one of the further compaction apparatus and at least one said control center, in order to be available for prior automatic adjustment of each area-specific apparatus compactor value for subsequent compaction process, in order that area-specific setting of a respective corresponding apparatus compactor value is carried out without any input from a driver of a compaction apparatus.

9. The method as claimed in claim 8, wherein a ground reaction force $F_B$ and a phase angle $\phi$ are calculated and adjusted automatically as an area-specific compaction value, with the phase angle $\phi$ being an angle between a direction of the maximum ground reaction force $F_B$ directed at right angles to the surface of the ground area and a direction of a maximum oscillation response of an oscillating system, formed from the ground area and the vibration unit, which carries out the compaction, of the compaction apparatus.

10. The method as claimed in claim 8, wherein the compactor value for the respective area is made available automatically prior to the area being driven over, with the time interval being chosen automatically such that the compactor value is automatically set on reaching the respective area.

11. The method as claimed in claim 8, wherein position co-ordinates of the respective area which is involved in the compaction process are determined, and the determined area-specific compaction actual value of the respective area is stored together with these position co-ordinates in order to be available for prior automatic adjustment of each area-specific compactor value for a possible subsequent compaction process.

12. The method as claimed in claim 8, wherein the area-specific compaction values determined while driving over the area are transmitted to at least one of the further compaction apparatus and at least one control center and with at least one of area-specific compaction actual values while previously having been driven over and compaction nominal values being received by at least one of the further compaction unit and the at least one control center.

13. The method as claimed in claim 8, wherein the respective area-specific first compaction actual value of the most recent previous compaction process or the respective area-specific compaction nominal value is compared with the area-specific compaction actual value measured while driving over for compaction, and an area-specific compaction difference value is determined, this compaction difference value is compared with a predetermined tolerance value and, if the compaction difference value is at least as small as the tolerance value, then, when driving over the area again, the compactor value is set such that no further compaction takes place and the apparatus is moved over the relevant area only for surface-smoothing purposes.

14. The method as claimed in claim 8, wherein a route for driving over the area is displayed in advance to the driver of the apparatus, on which route the compaction apparatus must be driven in order to compact a plurality of areas in an optimum time period and to minimize the number of times the area is driven over unnecessarily.

15. A method of co-ordinated ground processing for creation of a compacted ground area, the method comprising:

a) driving over at least one subarea of the ground area with a compaction apparatus which determines at least one relative, position-related compaction value while the area is being driven over, b) determining an absolute position-related compaction value in the subarea by utilizing a calibration apparatus, c) automatically transmitting information relating to relative and position-related absolute compaction values determined in step a) and b) to a computation unit, d) determining at least one correlation value between the relative and absolute compaction value, e) automatically transmitting the correlation value to the compaction apparatus, and f) readjusting a reference value in the compaction apparatus corresponding to the transmitted correlation value.

16. The method as claimed in claim 15, wherein the absolute position-related compaction value is determined at a first point in time, and the subarea is driven over in a non-compacting manner at a later point in time with the compaction apparatus in order to determine at least one relative, position-related compaction value while driving over this area.

17. The method as claimed in claim 15, wherein the subarea is driven over at a first point in time in a compacting manner by the compaction apparatus and at least one relative, position-related compaction value is determined while driving over this area, and in that the absolute position-related compaction value is determined at a later point in time.

18. The method as claimed in claim 15, wherein a further compaction apparatus is used as the calibration apparatus and is designed to determine not only relative but also absolute compaction values.

19. The method as claimed in claim 15, wherein a plurality of subareas are driven over both by the compaction apparatus and by a further compaction apparatus.

20. The method as claimed in claim 15, wherein data regarding material and layer thickness, relating to the layer structure is stored in the computation unit, and this data is associated with the compaction values.

21. A compaction apparatus for compaction of at least one ground area or of at least one covering area which is applied to a ground area to a predetermined area-specific compaction nominal value, the compaction apparatus comprising:

a) driving direction selection unit by means of which an apparatus driver can control the driving direction when driving over each area, b) storage unit for storage of area-specific compaction values, c) computation unit which interacts with the storage unit in order to determine apparatus compactor values from the compaction values, d) least one compaction unit which has an adjustment unit, e) wherein the adjustment unit interacts with the computer unit in order to set apparatus compactor values, having a position-finding unit for automatically determining the position co-ordinates of the respective area that is awaiting compaction, f) measurement unit for automatic determination of a respective area-specific compaction actual value, g) comparator unit for comparison of the respective area-specific compaction actual value with the associated area-specific compaction nominal value, h) data receiving and transmitting unit, which is connected for signaling purposes to the adjustment unit, and in particular to the comparator unit, for reception of area-specific compaction nominal values and area-specific compaction actual values from a previous compaction process and for transmission of the location of areas and their compaction actual values determined during the compaction process in order to automatically obtain area-specific apparatus compactor values, corrected by the adjustment unit, for a subsequent or for the instantaneous process of driving over the area for compaction so that the apparatus driver does not have to set compactor values while driving the apparatus.

* * * * *